United States Patent [19]

Fine

[11] Patent Number: 4,548,024

[45] Date of Patent: Oct. 22, 1985

[54] INTEGRATED STRETCH-WRAP PACKAGING SYSTEM

[75] Inventor: Harvey A. Fine, Sayreville, N.J.

[73] Assignee: Weldotron Corporation, Piscataway, N.J.

[21] Appl. No.: 580,129

[22] Filed: Apr. 16, 1984

Related U.S. Application Data

[62] Division of Ser. No. 245,283, Mar. 19, 1981, Pat. No. 4,458,470.

[51] Int. Cl.[4] ..... B65B 11/16

[52] U.S. Cl. ..... 53/502; 53/441; 53/389; 53/556

[58] Field of Search ..... 53/441, 427, 502, 66, 53/389, 556

[56] References Cited

U.S. PATENT DOCUMENTS

| | | | |
|---|---|---|---|
| 2,259,866 | 10/1941 | Stokes | 53/552 |
| 2,887,837 | 5/1959 | Toby | 53/258 |
| 3,162,258 | 12/1964 | Schmidt | 177/1 |
| 3,194,710 | 7/1965 | Stremke et al. | 156/360 |
| 3,244,278 | 4/1966 | Weprin et al. | 209/121 |
| 3,276,526 | 10/1966 | Loshbough | 177/3 |
| 3,289,386 | 12/1966 | Farmer | 53/28 |
| 3,293,824 | 12/1966 | Dorr | 53/131 |
| 3,342,661 | 9/1967 | Arvidson et al. | 156/360 |
| 3,372,079 | 3/1968 | Fellner et al. | 156/360 |
| 3,384,524 | 5/1968 | Hansen, Jr. | 156/360 |
| 3,453,167 | 7/1969 | Arvidson et al. | 156/360 |
| 3,461,984 | 8/1969 | Phillips et al. | 177/3 |
| 3,486,294 | 12/1969 | Vilen | 53/66 |
| 3,537,235 | 11/1970 | Pepmeier et al. | 53/379 |
| 3,540,971 | 11/1970 | Johanski, Jr. | 156/366 |
| 3,650,773 | 3/1972 | Bush | 99/171 R |
| 3,662,511 | 5/1972 | Eliasberg | 156/360 X |
| 3,732,966 | 5/1973 | Treiber | 156/360 X |
| 3,846,958 | 11/1974 | Divan | 53/153 X |
| 3,967,433 | 7/1976 | Bonfiglioli | 53/441 |
| 4,029,161 | 6/1977 | Foster et al. | 177/25 |
| 4,101,366 | 7/1978 | Teraoka et al. | 156/378 |
| 4,205,501 | 6/1980 | Michels | 53/556 |
| 4,276,112 | 6/1981 | French et al. | 156/360 |

OTHER PUBLICATIONS

Franklin Electric catalog, Section 200, p. 200.001, May 5, 1974, entitled Fully Automatic Shrink Film Wrapping; p. 200.005 entitled Fully Automatic Stretch Film Wrapping; p. 200.011 entitled Fully Automatic 180° Wrapping; p. 200.031 entitled Semi-Automatic Heated Belt System.

Toledo Scale flyer, designated Form SW-1452, undated, entitled 303MP For Stretch Or Shrink Film Packaging.

Toledo Scale flyer, designated Form 1454, undated, entitled 303MP/Auto-Labler, Single Station Wrap And Weigh Systems.

Toledo Scale flyer, desig. Form 1464, undated, entitled Super-wrapper, 513/Auto-Labeler, Single Station Wrap And Weigh System.

(List continued on next page.)

*Primary Examiner*—James F. Coan

*Attorney, Agent, or Firm*—Davis, Hoxie, Faithfull & Hapgood

[57] ABSTRACT

The disclosure concerns an integral weigh wrapper for wrapping products in stretch film, by weighing each product as it is placed on an infeed support surface, and feeding successive weight signals to a data processor. Successive signals are compared, and when a stabilized weight signal is received, as determined by the successive comparisons, the data processor produces a start signal which activates a drive motor to rotate one revolution. This initiates one cycle of operation of the weigh wrapper, in which the product is advanced from the infeed station to the wrapping station, a wrapping cycle is initiated for any product then in the wrapping station, and a previously wrapped product is advanced to a printing and labeling station—where it is automatically indexed, a printed label pneumatically applied to a selected location on the wrapper, and the wrapped and labeled product outputted.

22 Claims, 12 Drawing Figures

OTHER PUBLICATIONS

Toledo Scale flyer, design. Form 1466, undated, entitled The Step Saver System, Ideal For Packaging Produce Or Meats.

Toledo Scale flyer, design. Form 1470, undated, entitled Super-wrapper, Soft Film System No. 1.

Hobart 12 page brochure, undated, entitled Automatic Shrink Film Wrap-Weigh-Label Systems.

Franklin Electric catalog, Section 200, p. 200.069, Apr. 15, 1977, entitled Mechanical Console Hand Wrapper M-100 Series; p. 200.071 entitled Mechanical Console Hand Wrapper M200.

Franklin Electric catalog, Section 100, p. 100.021, May 5, 1974, entitled Digimatic Computer Scale; p. 100.023 entitled Digimatic Scale Printer.

Fig. 3.
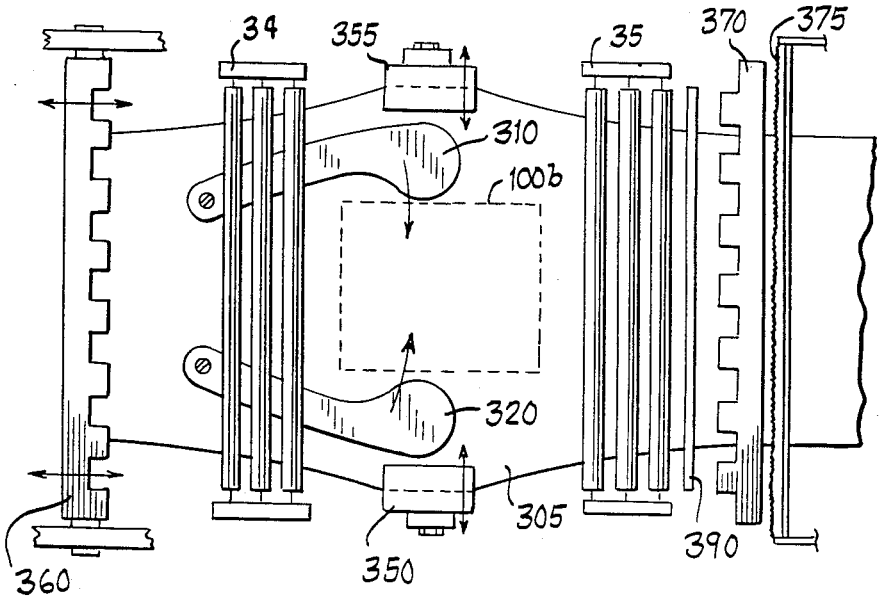
Fig. 4.
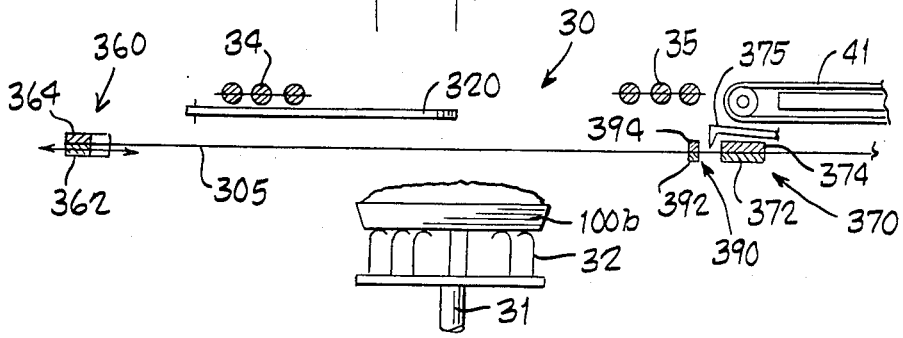
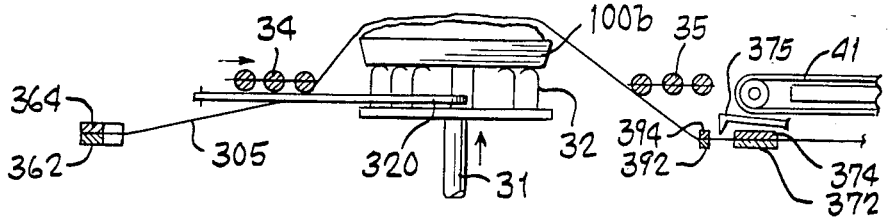
Fig. 5.

INTEGRATED STRETCH-WRAP PACKAGING SYSTEM

This application is a division, of application Ser. No. 245,283, filed Mar. 19, 1981 now U.S. Pat. No. 4,458,470.

BACKGROUND OF THE INVENTION

This invention relates to the field of packaging, and, more particularly, to packaging by an integrated stretch wrap system which weighs, prices and wraps products in a stretchable wrapping film, and labels the wrapped products.

Stretch wrapping is a packaging technique especially for trayed products, wherein stretchable plastic film is wrapped in a stretched condition around a product to produce a tightly conforming and attractive package. With the availability of high speed automatic stretch wrapping equipment, this technique is gaining increased acceptance, particularly for food packaging.

One important application for automatic stretch wrapping machines is in the packaging of fresh food products in individual supermarkets. The stretch wrapped fresh food products are very attractive, and the wrapping film also provides adequate breathing to maintain the wrapped food in a fresh state.

For supermarket application, however, stretch wrapping machines must be capable of wrapping products which vary considerably in size and weight over very short runs. An example of this is in the wrapping of fresh meat. When beef is being wrapped at a supermarket, for example, there may be 10 or 20 tenderloin steaks, followed by 10 or 20 T-bone steaks, followed by 10 or 20 trays of hamburger meat or various other cuts of beef. All of the pieces in any given run of these products may differ somewhat from one another in size and weight, and the difference is even greater from one short run of one cut to the next short run of another cut.

Moreover, since meat is a relatively expensive commodity, and it is generally sold on a per pound basis, it is essential that each individual package be accurately weighed, priced and labeled. Also, it is desirable that the label be consistently applied to the same general location of the package, regardless of variations in package size, so that the packaged goods may be conveniently displayed, with the price visible or readily ascertainable, and the goods quickly processed at the checkout counter. Further, the equipment must not only be accurate and adaptable to a variety of rapidly changing sizes and weights; it must also be relatively small, because of space limitations, simple to operate by unskilled operators, and relatively inexpensive.

These requirements are in contrast to the requirements for machines in central packaging locations, where space is generally not as critical, where the operators may be trained and experienced machine operators, where the cost is not so critical since the machine may run continuously through all working hours, and where one product may be wrapped continuously for hours or days, so that an appreciable set-up time for changing the machine to accomodate another product forms only a small fraction of the total operating time.

Because of the severe constraints on supermarket wrapping machines, weighing and labeling are generally performed separate from the wrapping, on a computerized electronic scale with a label printing and applying attachment. These scales require a manual input by a machine operator identifying the type of commodity, the unit price per weight, and the tare weight of the packaging material. Each product is typically wrapped in a wrapping machine and then transferred to the electronic scale. After weighing the wrapped product, the scale unit subtracts the tare of the wrapping material, to determine the net weight, and then multiplies the net weight by the unit price to determine the selling price. The price is printed on a label, along with the type of product, net weight, and unit price per pound, and the label is applied to the previously wrapped product. It may also be required to prepare and apply an additional label bearing the universal product code (UPC) for the particular wrapped product.

When the volume of packages being handled is low, the system described can be manually fed by an operator, handling each package individually in both the wrapping and weighing apparatus. However, when the volume of packages is high, such as is generally the case when the product is wrapped by automatic equipment, the separate wrapping and weighing apparatus must be converted to a compatible automatic system in which the weighing apparatus can accept and process the output of the wrapping apparatus. This automation is accomplished, in present supermarket equipment, by combining the computerized scale and labeling unit, and the wrapping machine, with an automatic indexing and orienting conveyor system. In these integrated systems, the conveyor system accepts packages from the discharge of the automatic wrapper, gates and indexes them at predetermined intervals, aligns them for proper presentation to the weighing station, transfers them in sequence to the weighing station, where they are weighed in turn, transfers them to an alignment station where they are aligned for the label applicator, transfers them to the label applicator station where the labels are applied, and finally, discharges the labeled packages.

There are several disadvantages to this system. First, the indexing and orienting systems are quite expensive, so that the complete system is very expensive. Second, the system is bulky, and requires an excessive amount of floor space. Furthermore, because of the size of the system, there is a considerable distance between the product input and controls of the wrapping machine and the controls of the scale, so that two operators are required, or one operator must move from one location to another for product changes. Indeed, since product changes are frequent, and a manual input to the scale control is required for every product change, either one operator is used to operate the system at a greatly reduced output rate, or two operators are required. These disadvantages and others are overcome by the present invention.

It is an object of the present invention to provide a relatively simple to operate, small, inexpensive and accurate system, operable by a single operator, to rapidly weigh, wrap, price and label numerous products of widely varying sizes, weights, and unit prices.

SUMMARY OF THE INVENTION

The present invention provides an integrated weigh wrapper which includes wrapping and computerized weighing and labeling in an intermittent motion, wrap-on-demand stretch wrapping machine. In a preferred embodiment, a single label bearing all required consumer and UPC information is applied to the proper wrapped package, at the proper location on the package, by the shifting of the associated label data through multiple buffer memory areas in the computerized weighing station, in synchronism with the cyclic operation of the wrapping machine. In this way, the proper data are automatically outputted from the computer memory when the label is being printed, and the proper label is thereafter applied to the proper location of the correct package. By taking advantage of the cyclic, start-stop operation of the automatic wrapping machine, each product is always at a known location, and the requirement for an automatic indexing and orienting conveyor is eliminated.

Moreover, the scale controls are mounted at the infeed of the wrapping machine, so that one operator can both feed products to the wrapping apparatus, and handle the controls for the wrapping, weighing and labeling. Also, since the product is weighed prior to the wrapping operation, the wrapping film is not weighed, and its tare weight need not be subtracted from the total package weight, thereby resulting in an inherently more accurate net weight and product price calculation.

The data processor associated with the computerized weigh station stores all the required data pertaining to numerous products that are to be wrapped, as well as performing all necessary calculations and inventory functions.

BRIEF DESCRIPTION OF THE DRAWINGS

FIG. 3 is a plan view of the wrapping station of FIG. 1 in greater detail;

FIGS. 4–7 are side views of the wrapping and sealing stations of FIG. 1, in greater detail, during consecutive operating stages of the apparatus;

DETAILED DESCRIPTION

Figure 1:
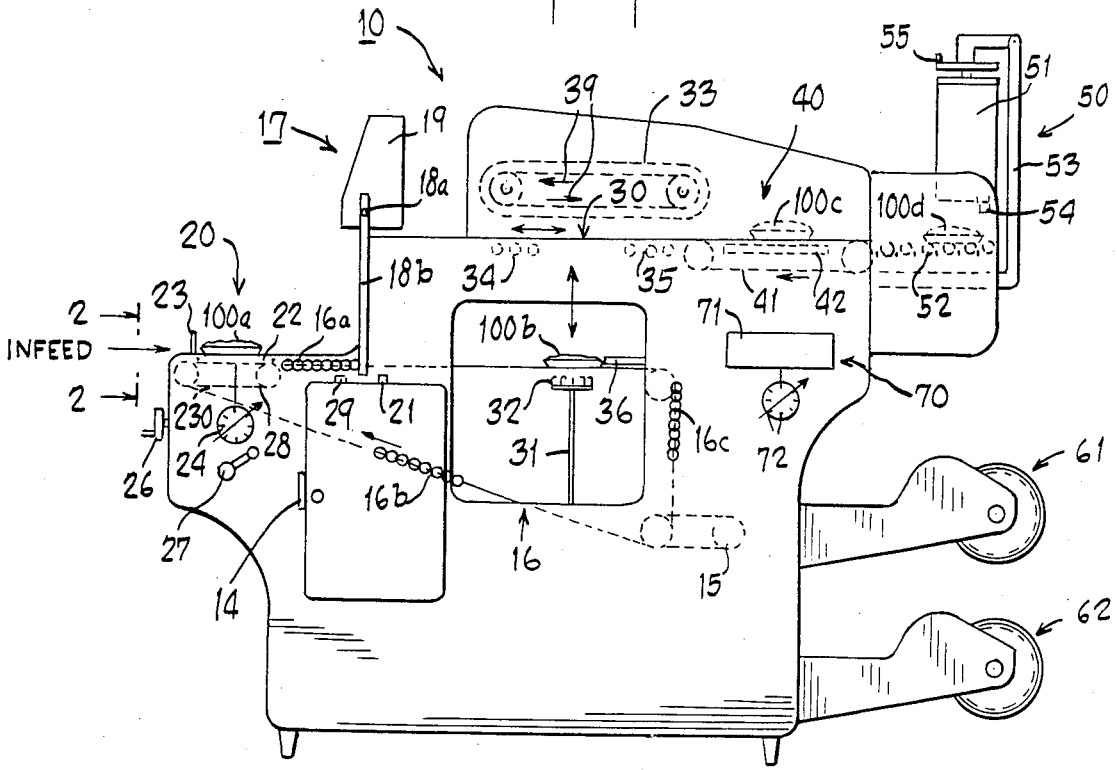
FIG. 1 is a schematic side view of apparatus embodying the invention.

FIG. 1 is a schematic illustration of a preferred embodiment of the wrapping machine of the present invention, which can be referred to as a wrap-on-demand weigh wrapper for stretch film. The weigh wrapper 10 is of unitary construction, as shown, and includes a main camshaft 15, an infeed conveyor 16 having three flights or sets of rollers 16*a*, 16*b* and 16*c*, a control station 17, a weighing and infeed station 20, a wrapping station 30, a sealing station 40, and a positioning and label station 50. Also, it includes two film supply rolls 61 and 62, and an auxiliary weighing station 70.

The control station 17 includes a data processor 19 pivotably mounted on a shaft 18*b* by a bracket 18*a*, to be pivotable about an axis formed by shaft 18*b*.

The weighing and infeed station 20 includes an infeed table or platter 22 for receiving and supporting a trayed product 100*a*. Mounted beneath the infeed table 22 are one or more weight sensing devices 24, shown schematically in FIG. 1, which are responsive to the weight of the trayed product 100*a*, and which transmit an electrical signal indicative of this weight through a cable (not shown) to the data processor 19. An infeed pusher 23 moves in the direction of the arrow labeled "INFEED", to advance the trayed product 100*a* onto one of the flights, such as flight 16*a*, of conveyor 16. The infeed pusher 23 is preferably mounted from a support arm 23*a*, shown in FIG. 2, which passes through a slot along the center of the infeed table 22. Support arm 23*a* is mounted on chain and sprocket assembly 28. This assembly provides the required movement of infeed pusher 23.

The weighing and infeed station 20 also includes various machine operating controls. These controls include clamp air pressure adjustment 14, cycle button 21, stop button 29, film length adjustment handle 26, and film roll change actuator 27.

The cycle button 21 will cause the weigh wrapper 10 to advance through one mechancial cycle of operation and then stop, for each depression of the button. This button is normally used when there has been a data processor failure. Sequential depressions of this button will cause a trayed product to be wrapped but not labeled. Depression of stop button 29 will cause the weigh wrapper 10 to stop all mechanical functions, while still allowing the data processor 19 to remain active. The film roll change actuator 27 has two settings to select which of two supply rolls 61 and 62, having film of two different widths, is employed at any particular time. The amount of film provided by either supply roll to wrap an individual trayed product is determined by the setting of film length adjustment handle 26.

The wrapping station 30 includes a lifter rod 31 supporting a product support elevator 32 to raise a product 100*b*, that has been received from the infeed conveyor 16, into a web of stretch film (not shown in FIG. 1). The film has been unrolled from one of the film supply rolls 61 or 62, and held in a stretch condition above the elevator 32.

When one of the flights 16*a* to 16*c* receives a trayed product from the infeed table 22, as a consequence of the advancing action of the infeed pusher 23, the flight conveys the product rightward to a stop member 36. At that point, the flight continues rightward but the trayed product is stripped from the flight by the stop member 36, so as to land on the product support elevator 32 with its front edge at a location fixed by the location of the left-most surface of the stop member 36. Once so positioned on elevator 32, the product is ready to be raised by the lifter rod 31 into the stretch film held above elevator 32, as will be explained.

The wrapping station 30 also includes side folding members (not shown in FIG. 1), and a rear folding member 34 in the form of rollers, for folding three of the edges of the stretch film under the trayed product 100*b*, after the trayed product has been raised into the stretch film to its uppermost position (just above the level of the rollers 34 and 35).

An overhead outfeed conveyor 33, preferably using sponge rubber belts is located at the top of wrapping station 30. This conveyor rests on each product, after the product has been raised into the wrapping film by elevator 32, so as to hold the film in place and exert a downward force on the product. After the side and rear edges of the wrapping film have been tucked under the product, by the tucking members, the outfeed conveyor 33 moves in the direction indicated by arrows 39 to advance the wrapped product onto an outfeed roller conveyor 35, thus tucking the forward edge of the film under the product to overlap the other tucks. The product then passes over a sealing station 40, where a product 100*c* is shown. The sealing station includes a belt conveyor 41 with a hot-plate 42 for sealing the film that has been tucked under the trayed product.

In the operation of the weigh wrapper 10, assuming at least four products are fed to the infeed station 20 in rapid succession, one product 100*c* will be in the sealing station 40, while the next product 100*b* is on elevator 32, and the next product 100*a* is being weighed in the weighing and infeed station 20. Also, a fourth product 100*d* will be in the positioning and label station 50, which includes an outfeed conveyor 52, a printer 51 and label applicator 54. Appropriately adjustable mounting members 53 and 55 provide means for mechanically adjusting the position and orientation, respectively, of the applied label with respect to the trayed product 100*d*. Printer 51 is electrically connected to the data processor 19 by a cable which is not shown.

An auxiliary weighing station 70 is included for the convenient weighing of products which are too large to be weighed on the infeed table 22 and wrapped by the wrapper 10. This station includes a weigh table 71 and weight sensing device 72. The weight sensing device 72 is preferably similar to the weight sensing device 24, which will shortly be described. It transmits electrical signals, indicative of the weight of an item placed on table 71, to the data processor 19. These signals will only be transmitted when an auxiliary switch, located on the operator's console of data processor 19, is actuated to indicate the selection of the AUXILIARY mode of operation.

Before discussing the preferred embodiment of the invention in any greater detail, the overall sequence of operation will be described with reference to FIG. 1.

There is a four cycle sequence of operation in the AUTOMATIC mode of the preferred embodiment. In this mode, as each new product to be wrapped is placed on the table 22 of the infeed station 20, successive weight signals are transmitted to the data processor 19, which then produces a start signal when the weight signals become stabilized, as will be explained, and a new cycle of the wrapper begins. Each such cycle corresponds to one revolution of the camshaft 15, and each trayed product is processed through four such cycles sequentially, where the following functions are performed:

(1) First cycle: transferring the newly received trayed product from weighing table 22, by means of pusher 23 and a conveyor flight 16*a*, 16*b*, or 16*c*, to elevator 32, on which it is properly indexed by the location of the end of stop member 36, (2) Second cycle: elevating the product on elevator 32 through the stretched film (not shown in FIG. 1), folding the side and rear edges of the film under the tray, then transferring the partially wrapped product onto the hot-plate conveyor 41, to fold the last edge of the film under the tray, to overlap the other edges, (3) Third cycle: transferring the wrapped product along the hot-plate belt 41, to seal the edges under the tray, and then transferring the fully wrapped product to the outfeed conveyor 52, and indexing it laterally, while printing the label, (4) Fourth cycle: applying the label to the properly indexed package, and then discharging the labeled package.

As the main camshaft 15 of the weigh wrapper 10 makes one complete revolution, the respective stations of the weigh wrapper each perform specific ones of the above functions. Thus, for each revolution of camshaft 15, the weighing and infeed station 20 performs the functions described above for the first cycle; the wrapping station 30 performs the functions described for the second cycle; the sealing station 40 performs the functions described for the third cycle (with some participation by the positioning and label station 50); and the positioning and label station 50 performs the functions described for the fourth cycle.

As a consequence, while each product to be wrapped is processed through the four-cycle sequence described, with the first cycle of the sequence beginning once the weight of the product has been effectively sensed, at any given time during the operation of the weigh wrapper 10, each of four different products in the weigh wrapper (e.g., products 100*a*, 100*b*, 100*c* and 100*d*) is being processed through a different one of the four cycles. Furthermore, since each cycle of operation is initiated by a new start signal, signalling that a new product has been detected and effectively weighed, the four cycles of operation are synchronized with respect to each other.

Thus, when a first trayed product is detected and weighed, it will produce a start signal which will initiate one cycle of operation, and the first product will consequently be advanced through station 20, to elevator 32. Thereafter, upon the receipt and weighing of a second product, a second start signal will be produced, and another operating cycle will be initiated. This will result in the second product being advanced through station 20 to elevator 32, and concurrently, the first product being advanced through station 30 to conveyor 41, and so forth, with each new product initiating another operating cycle and thereby advancing the new product and the products already in the weigh wrapper.

Since a product is advanced from the infeed table 22 at the outset of each cycle, a new product can be placed on this infeed table at any time thereafter. In order to operate the weigh wrapper at its maximum speed, each new product should be placed on table 22 shortly after the preceding product has been advanced from the table, at least sufficiently before the end of the cycle in progress to permit the weighing of the new product before the current cycle ends.

A typical speed of operation of the weigh wrapper is 25 to 30 products a minute. At this speed, the weigh wrapper has adequate time to weigh each new product before the first cycle ends for the preceding product. If the product feed from the operator is too slow, however, the weigh wrapper will have to wait at the end of each cycle until the next product has been received and weighed, with a consequent reduction in its operating speed.

It should be understood that all of the mechanical operations of the apparatus 10 are made to occur at predetermined points in a cycle of the sequence by causing the operations to occur at fixed angular rotations of the main camshaft 15. Such means for controlling the cyclic operation of a machine are well known in the art.

Considering the four-cycle wrapping operation for a single product in greater detail, at the beginning of the packaging run, the operator enters into the control station 17 the identity of the commodity to be packaged, and a designation of the tray size, if there is a change in the tray size being used, as will be explained. The data processor 19 also has stored in its memory the correct tare weight for the tray, the correct unit price for the commodity, and any other data required to prepare a label for the trayed product.

The products to be wrapped are received by the operator on trays, or trayed by the operator, and the first such trayed product 100*a* is placed on the infeed table 22. Weight sensing device 24 then generates a rapid succession of weight signals which are supplied to the data processor 19. The data process includes an analog-to-digital converter to digitize the weight signals. When the digitized weight signal reaches a stabilized value, as determined by a comparison of the successive weight signals and a stored stabilization function, data processor 19 interprets the stabilized value as the weight of trayed product 100*a*, and stores the signal corresponding to this value in its electronic memory.

In the preferred embodiment, plus and minus 0.002 pounds are used as the limits in a stabilization function. Thus, consecutive high-speed samples of the weight signal are compared with each other, and when three successive samples do not vary from each other by more than 0.002 pounds, one of those samples is used as the weight signal and stored for further calculation. Greater than three successive samples within the stabilization criterion could be required for stabilization, but generally three are sufficient.

Upon storing the weight signal from the weight sensing device 24, data processor 19 provides an electrical start signal to a motor (not shown) driving the main camshaft 15. This start signal causes the motor to start, and rotate camshaft 15 one revolution, and a cycle count number to be stored in the electronic memory of the data processor 19. The camshaft 15 causes the infeed pusher 23 to advance in a rightward direction to push the product 100*a* from infeed table 22 onto a section or flight 16*a* of conveyor 16, which is also being driven by the camshaft 15. The conveyor 16 then transports the product onto elevator 32, the product being stripped from the conveyor flight 16*a* by stop member 36, and its forward edge properly indexed on elevator 32, as the conveyor flight passes the stop member 36.

A one-revolution sensor (not shown) senses when camshaft 15 has made one complete revolution, and it generates an end-of-cycle signal. This signal is fed to data processor 19, for reasons to be discussed, and turns off the motor driving camshaft 15 if a new start signal has not yet been received from the data processor.

It should be noted that during the next cycle, conveyor section 16*b* will receive the new product from the infeed table 22. Thus, the main camshaft 15 will rotate three full revolutions, and three cycles will pass before the conveyor section 16*a* will again convey a product from the infeed table to the elevator 32.

Before the completion of the first cycle, the data processor 19 subtracts a stored value corresponding to the tare weight of the tray from the sensed weight of the trayed product, to obtain a net weight, and multiples this net weight by a commodity unit price. The tray weight, unlike the wrapping film weight, is fixed for each of several standard sized trays, and stored in the memory of the data processor 19. The results of the data processor calculations are stored in the first buffer memory area before the completion of the first cycle.

The second cycle in the sequence of operation will begin when data processor 19 detects a new stabilized weight signal from the weight sensing device 24, and it also receives an end-of-cycle signal from camshaft 15. This signifies that one completion revolution of the camshaft has been completed and a new product has been sensed and effectively weighed. At that point, the data processor 19 transmits another start signal to the motor for camshaft 15 to initiate another revolution of the camshaft. This causes lifter 31 to raise the trayed package 100*b* through a web of stretch film (not shown in FIG. 1) unrolled from roll 61 or 62. As lifter 31 continues to rise, the product 100*b* will be encased in a sheet of the film in a stretched state, and as lifter 31 reaches its uppermost position, three of the edges of the film are folded or tucked under the tray. The side edges are tucked by side folders 310 and 320, shown in FIG. 3, in a wiping action which wipes the tucked film against the bottom of the tray, as the outfeed belt 33 is exerting a downward pressure on the product. This causes the tacky film to stick to the bottom of the tray. The rear folder rollers 34 concurrently move forward (rightward in FIG. 1) to tuck the back edge of the film under the tray, to overlap the tucked side edges, and the package is then transferred to the outfeed conveyor rollers 35, by belt 33, to tuck the forward edge of the film under the tray.

During the second cycle, the new product, whose receipt initiated the second cycle, will also be conveyed from the infeed table 22 to the elevator 32, as already discussed for the preceding product. However, this explanation is essentially following one product through the four-cycle wrapping process—the product being designated 100*a*, 100*b*, 100*c* and 100*d* when it is in the successive stages of the weigh wrapper.

Additionally, before the completion of the second cycle, the label data in the first buffer memory area is shifted to a second buffer memory area.

The third cycle in the sequence of operation begins with the wrapped product 100*c* on hot-plate belt 41. Upon receipt of the next start signal, signifying a stabilized weight condition for a third product (after the second end-of-cycle signal), the wrapped product is transported along the heated belt 41 to seal the tucked edges of the stretch film beneath the tray, and then onto outfeed conveyor 52, where it is aligned for proper placement of the label. While the wrapped package is being sealed and aligned, data processor 19 outputs its label data properly formatted, from the second buffer memory area to a print memory area. The printer 51 then prints these data on a label.

The fourth cycle in the sequence of operation begins upon receipt and weighing of the next product (after the third end-of-cycle signal), and a consequent fourth start signal. During this cycle, the printed label is applied to the wrapped product 100*d*, which has been properly indexed by a positioning conveyor (not shown in FIG. 1). The wrapped and labeled product is then discharged by outfeed conveyor 52 to complete the final cycle of the operation.

It should be noted that each cyle in the sequence of operation was initiated by a new trayed product 100*a* being placed on the infeed table 22. Some accomodation must be made, therefore, for the last few products being wrapped, when no additional products are being supplied to the wrapper. In such a situation, after the last product has been supplied, and passed through the first cycle of the wrapping sequence, to rest on elevator 32, the weigh wrapper will stop. At that point, however, there will be three products, not completely wrapped and labeled, in the weigh wrapper. In order to complete the wrapping and labeling of these products and END OF RUN button (not shown in FIG. 1) is provided.

When the operator depresses the END OF RUN button, the apparatus enters the END OF RUN mode and operates through three more revolutions of camshaft 15. However, the sequence of operation is modified so that control station 17 will not produce any new label information, since no new products are being weighed in station 20, and only if a trayed product is in the wrapping station 30, on elevator 32, will wrapping film be withdrawn from one of the rolls 61 or 62 to the wrapping station. The end-of-cycle signal produced at the completion of each revolution of camshaft 15 provides a counter in the data procesor 19 with the required cycle count information for inhibiting film feed during the last two cycles of the END OF RUN sequence.

For similar reasons, an INITIALIZATION mode is provided in the weigh wrapper 10. This mode is implemented automatically when first starting up the weigh wrapper for a run of new products, and for any start occuring after an END OF RUN mode has occurred. This mode inhibits the positioning and label station 50 from printing and applying labels for the first three revolutions of camshaft 15. The end-of-cycle signals are also employed to provide the required count information to a counter in the data processor 19 in this INTIALIZATION mode. Alternatively, however, the start signals can be used to provide the count information in this mode.

Similarly, if one intends to wrap only one or two trayed products, or some other small number, the INITIALIZATION mode will inhibit the printing and affixing of labels until a wrapped product reaches the positioning and label station 50, and the END OF RUN button should be depressed after the last such product has been inputted and the weigh wrapper stops.

The END OF RUN button preferably includes a small light within the button, the activation of which can be controlled by the data processor 19. To control the activation of this light, a counter within the data processor is stepped by a signal derived from the 60 cycle power available for the weigh wrapper, and reset by each end-of-cycle signal. When this counter reaches a predetermined count, signifying a substantial time delay between the infeed of products, and the data processor 19 is receiving a signal from photocell 854, which will be discussed, signifying that a product is present on the outfeed conveyor 52, the data processor will transmit a signal to activate the light in the END OF RUN button. This light will alert the operator that it might be appropriate to depress the END OF RUN button.

It should be noted, however, that the END OF RUN mode need not be employed at the end of a commodity run if a different commodity run is to ensue immediately. Thus, before the last few products of a first run have been fully wrapped and labeled, and while they are still in the weigh wrapper 10, the control panel 17 can be operated to input the commodity information for the next run, and the next run begun, without employing the END OF RUN mode. In such a case, the inputting of the first three products of the second run will cause the outputting of the last three wrapped and labeled products of the first run, and each product will receive its correct label, in the manner already discussed. However, to avoid any confusion to an operator, it may be desirable to complete the first run using the END OF RUN mode, so that all the packages for that run have been outputted, before inputting the commodity information for the next run.

Also shown in FIG. 1 is auxiliary weighing station 70. When an auxiliary mode switch (not shown in FIG. 1) is actuated, the apparatus is placed in the AUXILIARY mode. This mode is used when a large package has been hand-wrapped, or is about to be hand-wrapped, and it needs to be weighed and labeled. In this mode, although the dual buffer memory of data processor 19 is not used, the data processor automatically subtracts a preset tare weight, control station 17 provides a visual display of the weight of the item placed on table 71, and printer 51 provides an appropriate printed label. The operator manually takes the label from the printer and places it on the package. In the AUXILIARY mode, the weigh wrapper does not perform any automatic wrapping, sealing or positioning functions, these functions being inhibited upon the activation of the auxiliary mode switch.

Figure 1A:
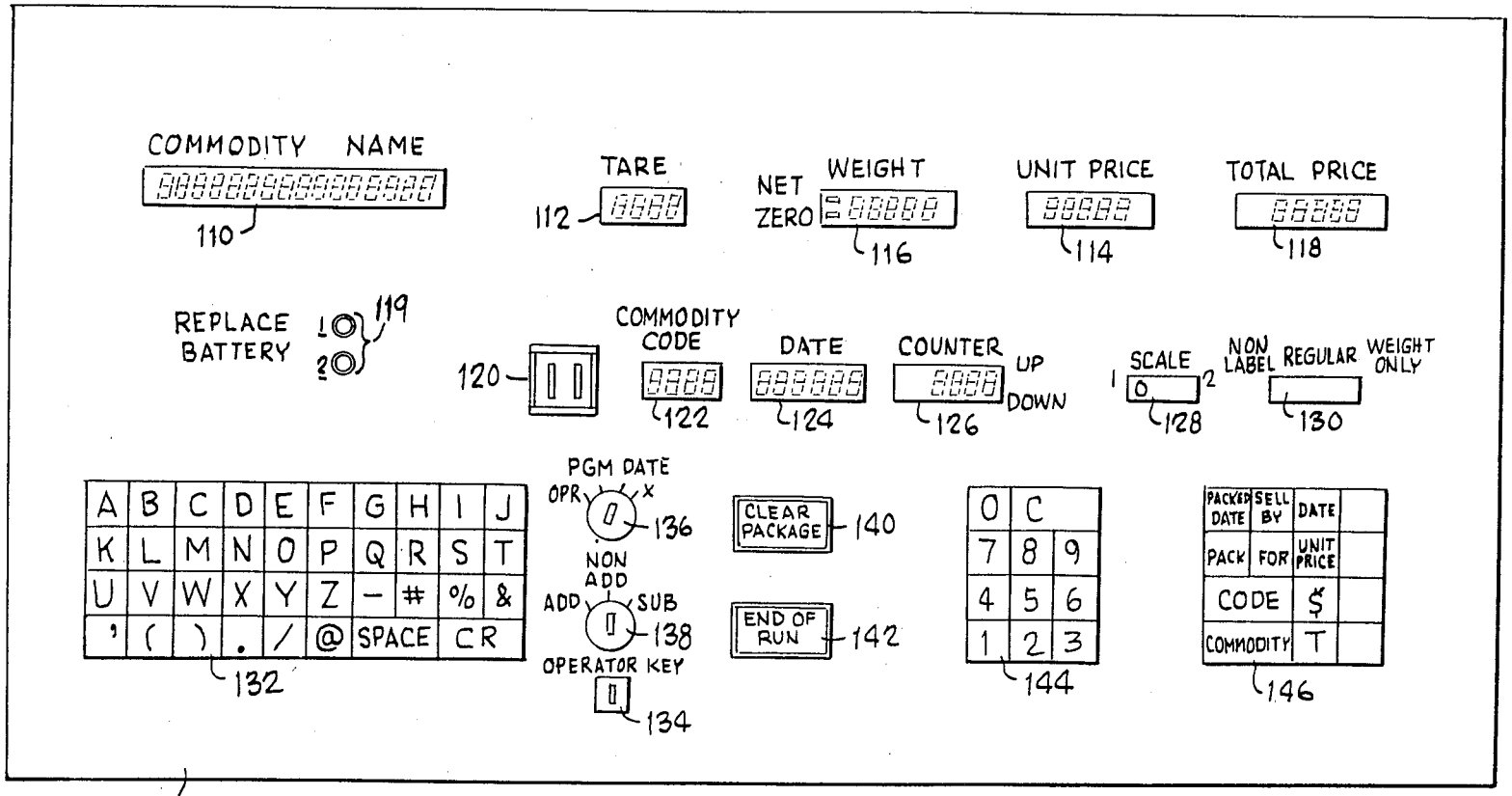
FIG. 1*a* is a schematic view of the operator's console of the control station of the apparatus of FIG. 1.

FIG. 1*a* is an illustration of a preferred operator's console 105 that forms the face of the control station 17 of FIG. 1. Console 105 includes eight visual display areas, each area being dedicated to the continuous display of a specific data field. These displays provide visual verification of the data to be printed on each label. Display area 110 includes a 16 character viewing field for the commodity description. This description may be of any alphanumeric combination selected by the user of the weigh wrapper 10 by means of the keyboards 132 and 144, to be described. It should be noted that the actual commodity description need not be limited to 16 characters. If a longer description is required, a larger character field may be dynamically displayed using a technique commonly referred to in the art as "rolling" or "scrolling."

Display area 112 is a four character viewing field for the tare weight of the product tray. This tare weight may be entered in any one of three modes. The first form of this data entry may be through the stored commodity data set defining a particular commodity. The tare weight is then produced from memory by the data processor 19 on the basis of the particular commodity designation, pursuant to an operator command at the beginning of a packaging run. The second type of data entry is a digital number representing the tare weight manually entered by the operator, using the tare entry key on keyboard 146, to be described. The third type of data entry also requires the use of the tare entry key; however, rather than further requiring a manual digital entry, the data processor 19 automatically interprets and stores, as the tare weight the weight signal generated by the load cell 24 in FIG. 2 at the time of the activation of the tare entry key.

Display area 114 is a five character viewing field. The unit price to be charged for the particular commodity then being packaged is displayed in this field. Although this information will normally be that accessed by the data processor, upon operator input of a commodity code, the value may also be temporarily overridden by an operator having a proper security key. The operation of the security key will shortly be further described.

Display area 116 is a five character viewing field that is used both to display the net weight of the product, and to provide a general purpose display area. This display area is used to display an indication of when the scale is displaying the trayed product's weight less its tare weight, (i.e., "NET") and when the scale is ready to receive a new trayed product, (i.e., "ZERO"). This latter visual indication will not be activated until the zero tracking function has been accomplished. This function automatically zeros the scale before a product tray is placed on the infeed table 22 of FIG. 1. This function is automatically repeated after each product tray is transferred off of the infeed table. The zero tracking function is particularly advantageous when the infeed table is accumulating extraneous material, such as blood drippings from fresh meat, during a wrapping run.

Display area 118 is a five character viewing field that displays the total price of the trayed product, as computed by the data processor 19.

Display area 122 is a four character viewing field which, when read in conjunction with dual thumbwheel 120, indicates the six digit commodity code that has been assigned by the user for the particular commodity to be wrapped. The entry of this six digit number by the operator at the beginning of a packaging run will cause the data processor to access and display the appropriate commodity data set stored in its memory. Ordinarily, the two digit thumbwheel is used to designate the particular store department associated with the commodity indicated by the succeeding four digits displayed in area 122. When a commodity data set is initially defined in the data processor of the weigh wrapper, in a manner to be explained, the commodity code will be the first item entered into the keyboard section of the console by the user. The commodity data entered immediately thereafter will be associated with the commodity code so assigned.

Display area 124 is a six character viewing area for the "PACKED DATE." This area may also display, on an intermittent basis, the date by which a particular commodity may be sold, or the "SELL BY" date.

The final viewing field is display area 126. This four character display area is used to display the total count of packages wrapped in the current commodity run. When the associated counter of data processor 19 is in the UP mode, a count of total packages wrapped is displayed; when in the DOWN mode, the counter will count down from an operator entered number representing the total number of packages desired to be wrapped. When this count equals three, the data processor enters the END OF RUN mode previously described. At the end of the commodity run, the weigh wrapper automatically stops and accepts no further trayed products from the weighing and infeed station unless the operator initiates a new commodity run from the console 105.

Two slide switches are also provided on the console 105. Switch 128 permits the operator to select either the normal AUTOMATIC mode ("1") of the weigh wrapper, or the AUXILIARY mode ("2"). The AUXILIARY mode is used in conjunction with the auxiliary weighing station 70 of FIG. 1, as previously explained. Switch 130 permits the operator to select one of three label printing formats. When the "REGULAR" format is selected, the printer will prepare a full label bearing all printable package data. The "WEIGHT ONLY" format is selected when only the trayed product's weight is to be printed on the label. When the "NON LABEL" format is selected, in the leftmost position of switch 130, no label will be generated and no data will be inventoried. This format will ordinarily be used when a previously wrapped package is being double-wrapped. This action is normally required for a package that may be dripping.

Two alphanumeric keyboards are also provided on console 105. Keyboard 132 is primarily an alphabetic and symbol keyboard consisting of 38 keys. Its primary function is to input the descriptive commodity name corresponding to a user-assigned commodity code. The CR key permits entry of up to 48 printable characters in a multiple line format. All of the printable characters may be displayed in a rolling manner in area 110 of the console. Keyboard 144 provides a numerical input device consisting of 11 keys. The "C" key permits the operator to clear an incorrect entry from the memory of the data processor.

Console 105 further includes three key station areas, each station area requiring a separate key to unlock and activate it. These three key stations provide an extensive system of in-store security. Station 134 requires an operator's key to be inserted before the weigh wrapper will receive power. This key station will accept sixteen different keys. Fifteen of these keys correspond to fifteen different operators, and insertion of one of these keys results in a single-letter operator code being printed on all labels produced while that key is inserted. The sixteenth key, if inserted, results in no such code being printed.

Key station 136 provides for the insertion of a "mode" key and, depending upon which of two keys is inserted, three different security levels may be selected. If no mode key is inserted, the console is in a normal operating mode (OPR). In the OPR mode, the operator may temporarily override the commodity and price information stored in the data processor 19, but only for the current packaging run; at the end of the current run the data so entered are cleared. If a level I key is inserted in the key station 136, the operator may select one of two additional modes (PGM or DATE). In the PGM mode, the operator may alter the stored entries of all commodity and price data, or define a new commodity data set. In the DATE mode, the operator may set a clock/calender in the data processor. Also, he may set a "SELL BY" date for a particular commodity, and he may also set a store code corresponding to the code number of the store where the weigh wrapper is located. If a level II key is inserted in key station 136, the operator may further select the X mode to totalize the day's packaged inventory by commodity and price. This information may be printed by means of a journal printer (not shown) located in control station 17.

Key station 138 permits operator selection of three possible totalizing memory modes. When no key is inserted, the ADD position is selected, and the data processor 19 will operate in a normal totalizing mode, i.e., for each wrapped package, cumulative price, weight, and package count data will be stored by commodity type in the totalizing memory, after a label for that particular package has been printed. When the NON-ADD position is selected after insertion of the proper key, the totalizing function is disabled and nothing further is stored in the totalizing memory of the data processor. This position will normally be utilized when a rewrap of a trayed product is required. In this case, a separate rewrap memory will be accessed by the data processor 19 in order to maintain a record of all rewrap events. When the SUB position is selected by the operator, the totalizing memory will be reduced by an amount indicated by the operator. This position will normally be used to remove an error from the totalizing memory. In this mode, also, a record of all transactions will be stored in a separate memory area.

Console 105 also includes two push buttons. Push button 140 is the CLEAR PACKAGE button. This button is depressed to clear the buffer and print memory areas of the data associated with the trayed products then in the weigh wrapper. This button will normally be used when a manual unloading of the weigh wrapper has been required. No label will be printed when this button has been depressed. The second push button 142 is an END OF RUN button. This button is depressed by the operator when he has placed the last trayed product for a particular commodity run in the infeed and weighing station, as previously discussed. This action will initiate the END OF RUN mode sequence already described.

Function keyboard 146 is used to initiate operator entry of the commodity and price data. Normally, in order to make a data entry, one of the function keys would first be depressed; then the correct data would be entered using alphanumeric keyboards 132 and 144. The PACKED DATE key is used to enter the date the product was packaged by the weigh wrapper 10. The SELL BY key is used to enter the date by which a particular commodity must be sold. The depression of this key is followed by the entry of a number from keyboard 144. This number represents the number of days between the "packed date" and the "sell by" date. Data processor 19 automatically adds this number to the "packed date" prior to printing the "sell by" date on a label. The DATE key is used to set an internal clock-/calender in the data processor. This entry is only allowed after the operator has selected the DATE mode of key station 136. The PACK key is used to set a total count desired for a particular run, using the counter associated with display area 126, as already explained. The "T" key permits the operator to enter a tare weight, as previously discussed with respect to visual display area 112. The tare weight data set entry is accomplished by depressing the "T" and then depressing the appropriate numerical keys on keyboard 144 corresponding to the tare weight.

The FOR and $ keys are used to set the price for those commodities sold on a quantity or count basis, rather than on a unit weight basis. Apples are an example of such a commodity. In the PRICE BY COUNT mode, the user would enter the commodity price by first entering a quantity on keyboard 144 and depressing the FOR key, then depressing the $ key and entering a monetary value on keyboard 144. In addition to printing on the label the data so entered by the user, the unit price is computed by data processor 19 and printed.

The UNIT PRICE key is used to enter the price per unit weight of a particular commodity. This key is used when the PRICE PER COUNT mode is not appropriate.

The CODE and COMMODITY keys are used to initiate the entry of data which will be displayed in display areas 122 and 110, respectively. The commodity code is entered on keyboard 144 and the commodity name is entered on keyboard 132. When initially entering a particular commodity data set, the CODE and COMMODITY keys are the first function keys depressed by the user. The commodity information thereafter entered in the console is associated with that particular commodity. Once these data are entered by the user into the commodity memory of data processor 19, the operator of weigh wrapper 10 need only select the appropriate commodity code to initiate a commodity run. The selection of this code automatically causes the associated commodity data set to be accessed by data processor 19 from its memory.

Console 105 also includes a battery indicator 119 to signal the operator when the batteries supplying power to the memory components of data processor 19 require replacement.

Figure 2:
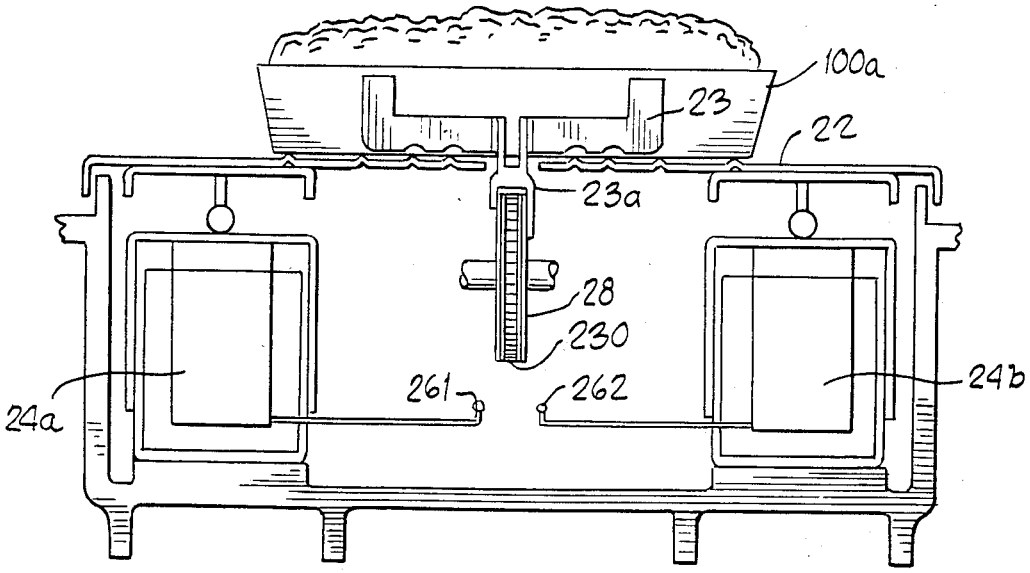
FIG. 2 shows the weighing and infeed station, to an enlarged scale, with conveyor chain 16 and other details omitted for clarity. This is an end view from the direction of lines 2—2 of FIG. 1.

FIG. 2 portrays a more detailed view of the weighing and infeed station of the weigh wrapper of FIG. 1. At the beginning of a cycle, the trayed product 100*a* is placed by the operator on infeed table or platter 22 in front of infeed pusher 23. Platter 22 is mounted on dual load cells 24*a* and 24*b* which form part of the weight sensor 24 of FIG. 1. Such load cells are well known in the art and provide an electrical signal, usually by means of self-contained strain gages, indicative of the weight of a load placed thereon. This weight signal is provided at terminals 261 and 262. A cable (not shown) is connected to terminals 261 and 262 to transmit this signal to the data processor 19 in the control station 17 of FIG. 1. The data processor includes one or more appropriate analog to digital converters to digitize the signals received from the load cells. The data processor 19 can alternatively be located in any convenient place, including immediately beneath the load cells. After the weight signal is processed by the processor 19, a start signal is generated and supplied to the motor (not shown) which drives the main camshaft 15, as already discussed. This initiates the operation of the motor for one revolution, as also discussed. Camshaft 15, in turn, drives the pusher chain 230 one revolution to advance infeed pusher 23. The chain 230 and infeed pusher 23 make one complete revolution around the rollers shown beneath the trayed product 100*a* in FIG. 1. The pusher first advances along the top of platter 22, and then returns beneath the platter, to again come to rest in the position indicated in FIGS. 1 and 2. When infeed pusher 23 is at its most extreme rightward position, it will cause the trayed product 100*a* to be transferred from platter 22 onto a conveyor flight 16 shown in FIG. 1. The operation of pusher chain 230 and conveyor 16 may by synchronized by operating the chain and conveyor on a common sprocket. In this way, pusher chain 230 may be caused to complete three revolutions for each full revolution of conveyor 16.

FIGS. 3 to 7 illustrate in greater detail the preferred embodiment of the wrapping station of the apparatus of FIG. 1.

FIGS. 3 to 7 include a web of stretch film 305 which can be drawn from either of the two film supply rolls 61 and 62 in FIG. 1, the film 305 is held at its forward end by film feed clamp 360 (comprised of lower and upper sections 362 and 364, respectively), laterally held by right side clamp 350 and left side clamp 355, and rearwardly held by film distributor 370 (comprised of lower and upper sections, 372 and 374, respectively). The actual gripping force of the clamps is regulated by air pressure, and may be varied by pressure adjustment 14 of FIG. 1. These figures also include folding or tucking members which include a rear folder 34, a right side folder 320, a left side folder 310, and forward or outfeed conveyor rollers 35. FIGS. 3 to 7 also show a knife 375, a rear clamp 390 (comprised of lower and upper sections 392 and 394, respectively), a trayed product 100*b*, a lifter rod 31, and an elevator table 32 with collapsible product support fingers. The operation of the folding or tucking members, and that of the collapsible support fingers, are disclosed in Fabbri U.S. Pat. No. 3,622,513 and Zelnick U.S. application Ser. No. 196,852, filed Oct. 14, 1980 now U.S. Pat. No. 4,388,796 both of which are incorporated herein by reference.

FIGS. 3 and 4 portray the apparatus at the end of a revolution of the camshaft 15 of FIG. 1, at which time the film feed clamp 360 has withdrawn a portion of stretch film 305 from film distributor 370. It will be observed in FIG. 3 that clamp 360 has a series of teeth which mesh with a similar series of teeth on distributor 370. Clamp 360 moves to the right, until its teeth mesh with those of distributor 370, and its members 362 and 364 then close upon evenly dispersed edge portions of the stretch film 305, that is being held by the distributor clamp 370. Clamp 360 then returns leftwardly, to its position in FIGS. 3 and 4, to withdraw the film 305 to the position shown in these figures. By the end of the revolution of camshaft 15, rear clamp 390, comprising lower and upper parts 392 and 394, has also closed to securely hold film 305, and side clamps 350 and 355 have moved toward each other, closed on the side edges of the film, and returned to their positions shown in FIG. 3 to stretch the film. Elevator 32 now bears a trayed product **100*b* in its lowermost position beneath the web of stretch film 305**, ready to be elevated.

Figure 6:
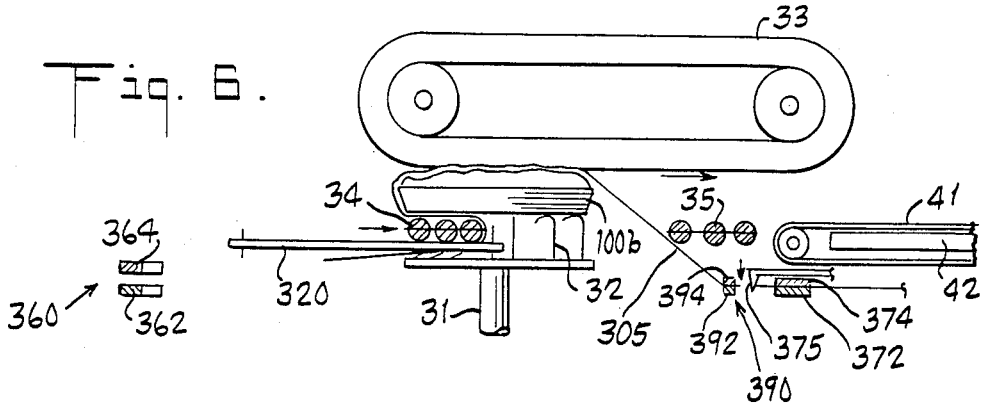
Figure 7:
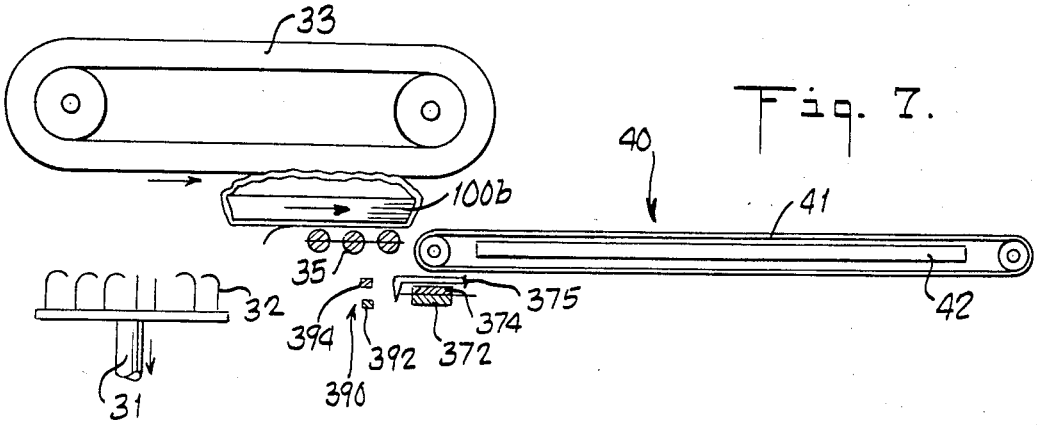

FIGS. 5 to 7 portray the wrapping apparatus during the succeeding revolution of the camshaft 15 of FIG. 1.

FIG. 5 illustrates lifter rod 31 raising the elevator 32 and trayed product **100*b*, so that the product 100*b* is being pushed into film 305, until lifter 31 reaches the top of its stroke just above the level of rear folder 34 and front folder 35. These folders, in turn, are just above the side folders 310, 320, as shown in FIG. 5**.

FIGS. 6 and 7 portray the wrapping process after the product **100*b* has been elevated, but still during the same revolution of camshaft 15. As lifter 31 reaches the top of its stroke, the rear and side clamps 360, 350 and 355, release their grips on the film, and the rear folder 34 and side folders 310 and 320 advance toward the elevator 32 and trayed product 100*b*. The folding members effectively catch the loose edges of the previously-stretched film, which are now retracting toward the product, and wipe these edges against the bottom of the tray to produce side folds which adhere to the bottom of the tray and a rear fold which overlaps the side folds, and adheres to the bottom of the tray and to the side folds. The adhesion is facilitated by the tackiness of the stretch film and the downward pressure exerted by top outfeed conveyor 33**, which consists of a set of belts comprised of thick, soft plastic material mounted on driven rollers.

At this point, as shown in FIGS. 6 and 7, the knife 375 passes through web 305 in front of film distributor 370, to thereby sever a sheet of the film from one of rolls 61 or 62 of FIG. 1. As the film is being severed, package **100*b* is advanced to hot-plate belt 41, and the last fold is made under the package as the tray moves onto the rollers 35. As the product is moving onto rollers 35, the trailing end of film 305 is still clamped by rear clamp 390 to facilitate the final fold under the tray, but the rear clamp 390** releases at this point, as shown in FIG. 7. The final fold generally overlaps the rear and side folds which have already been made.

Upon reaching hot-plate belt 41, wrapped package **100*b* comes to rest, this being the end of a revolution of the camshaft 15 of FIG. 1. During the first half of the next revolution of camshaft 15, the wrapped package then traverses the upper portion of hot-plate belt 41**, to further strengthen the seal originally formed by virtue of the tackiness of the film, and to thereby effect a seal of the folded edges of the film under the product tray.

FIGS. 8 to 11 portray a preferred embodiment of the positioning and label station 50 of FIG. 1. Shown in these figures are the outfeed portion of hot-plate belt 41, the wrapped package **100*d*, outfeed conveyor 52, printer 51, label applicator 54, label 880, stops 910, 915, micro-switch 920, photoelectric transmitter or light source 852 and photoelectric receiver 854. Also shown are air cylinder 871, 872 and a positioning conveyor 870, having pivots 873, rigid connecting members 874, rigid mountings 875 and a set of polycord belts 876**.

Figure 8:
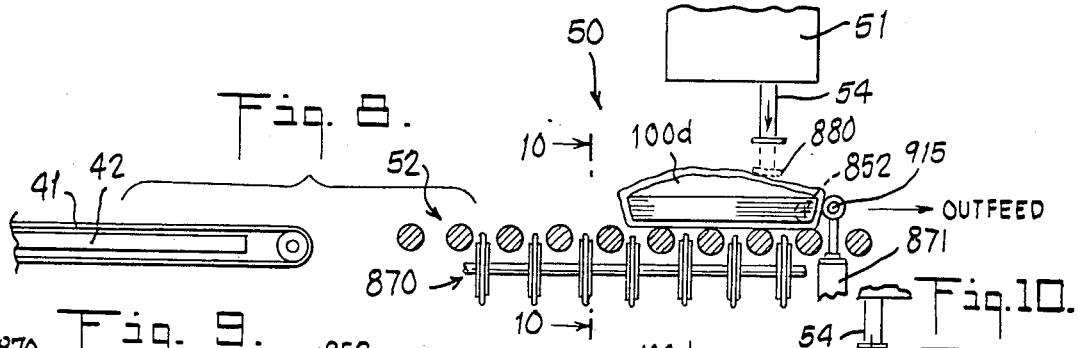
FIGS. 8 and 9 are a side view and a plan view, respectively, of the positioning and label station of FIG. 1, in greater detail.

FIG. 8 portrays the wrapped package **100*d* after it has been transferred from the hot-plate belt 41 onto the outfeed conveyor 52. The outfeed conveyor 52 includes a set of conveyor rollers interconnected by pliable belts (not shown) which are driven by camshaft 15 of FIG. 1. The package will continue to advance toward the OUTFEED end of the apparatus until it crosses the path of a beam of light emitted by photoelectric transmitter 852, which beam is otherwise received by photoelectric receiver 854. When this beam of light is interrupted, an electric activation signal is generated by the photoelectric receiver 854, which signal causes the retractible stop 915 and positioning conveyor 870** to operate.

Air cylinder 871 is activated immediately, upon receipt of the signal from photoelectric receiver 854, to raise the stop 915, and thereby provide a positive stop member for the package **100*d***.

Figure 9:
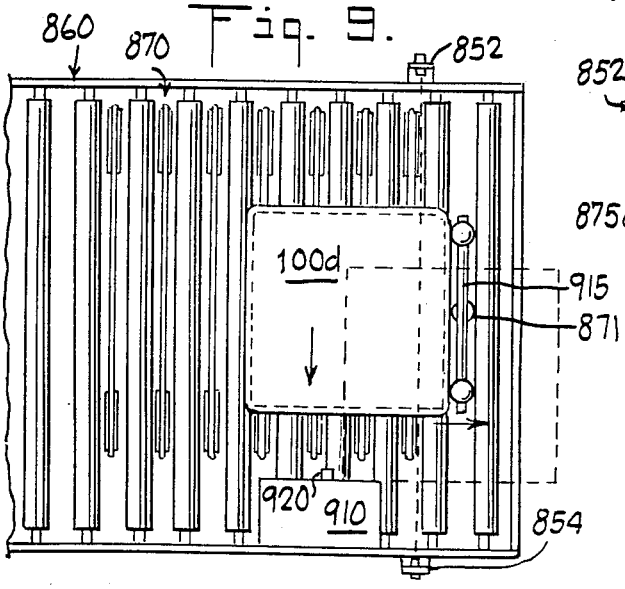
Figure 10:
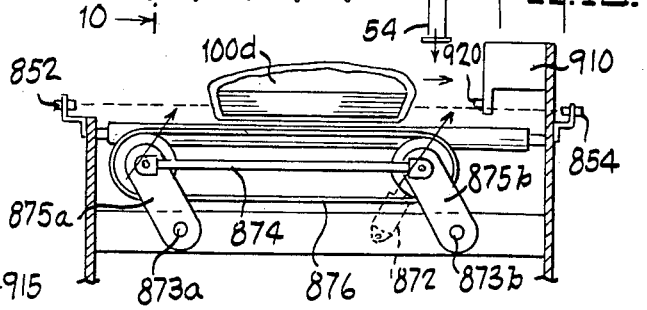
FIG. 10 is a cross-sectional view of the positioning and label station of FIG. 1, in greater detail, as viewed from the infeed side of the apparatus.

The operation of the positioning conveyor 870 may be more clearly understood by referring to FIGS. 9 and 10. When the activation signal is generated by the photoelectric receiver 854, air cylinder 872 causes a piston located therein to move again st rigid mounting member **875*b* a small interval of time after stop 915 has brought package 100*d* to rest. The rigid mounting members 875*a* and 875*b* then pivot about pivot rods 873*a* and 873*b* so as to raise the uppermost portion of the positioning conveyor 870 from beneath the plane of the top of outfeed conveyor 52 to a height above this plane. The elevation of the positioning conveyor 870 results in this conveyor 870 lifting the wrapped package 100*d* off the discharge conveyor 52. Since positioning conveyor 870 is being driven at an angle of 90° to the direction of motion of discharge conveyor 52, the direction of movement of the wrapped package 100*d* changes by 90°. Package 100*d* will continue to move in this new direction until it reaches stop 910. When the package strikes stop 910, it also strikes micro-switch 920. Micro-switch 920 then transmits a package-detect signal to data processor 19 of FIG. 1**, indicating that the wrapped package is properly aligned in the positioning and label station, and is ready to receive a label.

Also, printer 51 contains a sensor (not shown) to indicate when a printed label is in applicator 54. This sensor may be any one of several commonly available types generally known as a proximity sensor. When this sensor detects the presence of a label it causes printer 51 to transmit a label-detect signal to data processor 19. If the data processor receives a label-detect signal, but fails to receive a package-detect signal because of a package failing to reach the positioning and label station, an audible operator alarm is activated by the data processor.

Figure 11:
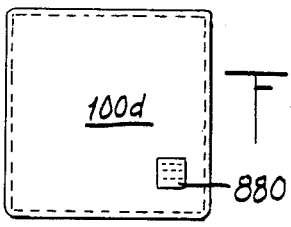
FIG. 11 is a plan view of a wrapped and labeled package as discharged from the apparatus.

When the data processor 19 receives both the package-detect and label-detect signals, the data processor transmits a label-eject signal to the printer 51. Upon receipt of this signal by the printer, applicator 54 is caused to pneumatically eject an adhesive label 880 to strike the package 100*d*. Thus, label 880 is always applied to the same location on the package, as measured from the front and right edges of the product, as shown in FIG. 11. The portion of package 100*d* which receives label 880 may, however, be conveniently varied by adjusting the position of the printer and applicator by means of the mounting member 53, shown in FIG. 1, and the orientation of the applied label may be varied by swiveling the printer and applicator about mounting member 55. The pneumatic application of the label permits it to be applied to irregular surfaces.

After the label applicator 54 ejects its label 880, it generates a deactivation signal, which causes the pistons in air cyclinders 871 and 872 to retract, thereby causing stop 915 to descend, so that it no longer impedes the motion of package 100*d*, and the positioning conveyor 870 to descend beneath the plane of the top of the discharge conveyor 52. The labeled package then resumes its motion in the direction of the arrow labeled OUT-FEED in FIG. 8, and the discharge conveyor 52 discharges the wrapped and labelled package from the apparatus.

This discharge may be to an additional conveyor, which will collect the wrapped and labeled packages.

As previously noted( the apparatus of the invention requires the use of a data processor. A preferred embodiment of the data processor uses a presently available microprocessor having a sufficient number of input and output data channels to communicate with the sensing devices, the label printer, the applicator, and the motor driving circuitry, and having an input/output capability for the various operator controls and displays located on the console 105 of FIG. 1*a*. One such microprocessor is commonly known as the type Z-80. A number of microprocessors may also be used to form a single data processor. The data processor also includes all the interface and control circuits that are necessary for the microprocessor to communicate with the remainder of the weigh-wrap apparatus. The use of such circuits is well known to those skilled in the digital computer art.

The data processor 19 may also advantageously contain a processor-to-processor data communications interface. This interface may be implemented using a standard commercial interface such as EIA RS-232-C. In this way, the weigh wrapper's data processor could communicate with a remote computer and the remote computer could emulate all functions of the operator's console. This capability would allow, for example, remote programming of the weigh wrapper's commodity data set, as well as remote storage of the weigh wrapper's cumulative inventory information.

In addition to control storage, which may be a read only memory (ROM), the memory of the data processor is required to be suitably sized and flexible to accomodate the sensed weight signal as well as the required commodity data sets for the integrated system. A preferred data set comprises the commodity code, the commodity name, the tare weight, the price per pound (or quantity), the universal product code (UPC) information, and the "packed" and "sell by" dates. The commodity data sets are stored in random access memory (RAM). This RAM is powered by a battery so that the commodity data are not lost when the weigh wrapper 19 is turned off. A typical supermarket application would require suitable RAM memory for several hundred different commodities.

Additionally, buffer memory and print memory are required for the preparation, formatting and coordinated storage of the information to be printed on a label for a particular wrapped package. This memory will be segmented so as to store the data associated with each new trayed product placed onto the infeed table of the apparatus. The data so stored will include that indicative of the commodity type, the price per pound (or quantity), the total weight (or quantity), the total price, and any other information desired to be printed on the label associated with the trayed product. A preferred embodiment of this memory is segmented random access memory, where each segment is of a size suitable to store the data to be printed on a label, and where the data are moved from one memory segment to the next each time a new trayed product is placed on the infeed table of the apparatus, or when the data processor 19 otherwise generates the appropriate signal. The final segment of this memory will be outputted at the proper time to the printer apparatus, thereby to generate the correct data for the label then to be printed.

It should be noted that the invention is not limited to the use of random access buffer memory, and that a suitable shifting memory, such as a shift register, may be used in a manner well known in the computer art, to generate and transfer the correct data at the correct time. The shift register would receive a pulse each time a trayed product is moved from one station area to the next station area. Moreover, rather than actually moving the data to be printed in memory, a ring counter or pointer may be used to direct the data processor 19 to the correct segment of the memory containing the desired data. In this case, the ring counter or pointer is incremented in a manner well known in the computer art each time a new trayed product is placed in the infeed and weighing station 20 of FIG. 1, or when the data processor 19 otherwise generates the appropriate signal.

The data processor 19 of the invention also includes a totalizing memory to perform certain inventory functions. This memory will store, on a per commodity basis, the total number of packages wrapped, the total weight (or count) wrapped, and the total monetary value of the products wrapped. These data will provide a useful check on instore pilfrage and loss. The data may be either viewed in the processor's visual display, or provided at output terminals (not shown) which may be accessed by an additional peripheral device, such as video or a printing unit. Furthermore, the console 105 of FIG. 1*a* is also provided with a journal printer (not shown) which provides a printed inventory tape at the end of the day.

The label printing station of the invention includes a suitable electronically programmed and activated printer. A preferred embodiment of the printer is an electronically activated, non-impact printing device, having the capability to generate labels at a speed at least equalling the cyclic rate of the main camshaft of the weigh wrapper. One such device is a matrix-type, thermal printer which produces a high quality image on the surface of a heat sensitive label. Such a printer is also used to generate the required universal product code (UPC), both in bar-code form and alphanumeric form, on each label. It should be observed that the use of a printer which is electronically programmable by the data processor normally eliminates the need for operation intervention at the printing and label station. As previously mentioned, the printer 51 and the label applicator 54 are located on adjustable mounting member 53 so that the printer and applicator may be easily repositioned.

It should perhaps be mentioned that while the weigh wrapper operates in successive cycles, as explained, one cycle may follow immediately after another, without any pause. Thus, at the time the main camshaft 15 completes one revolution, and sends a pulse to the data processor 19, if a stabilized weight signal has already been received by the data processor 19, the drive motor for the main camshaft will receive a start pulse from the data processor, and the camshaft will continue rotating. Indeed, this is the normal full-speed operation of the weigh wrapper, and any indication in the foregoing explanation that the trayed product will come to rest at some location at the end of a cycle, should be understood to be for purposes of explanation and subject to the fact that the product motion is virtually continuous during full-speed operation—even though each successive cycle, and rotation of camshaft 15, is initiated by a data processor produced start pulse.

Other changes and variations will occur to those skilled in the art in view of the foregoing discussion. It is intended that such changes and variations be encompassed, so long as applicant's invention is employed, as defined by the following claims.

What is claimed is:

1. A method for weighing, stretch wrapping and labelling a trayed product in a unitary weighing and wrapping machine for use in supermarkets, retail stores, and the like, comprising:

manually placing an unwrapped trayed product to be weighed and wrapped on a scale in a weighing station that is an integral part of said machine;

weighing the trayed product while it is on said scale before it is wrapped, including generating an electrical signal corresponding to the weight of the unwrapped trayed product;

withdrawing a length of stretch wrapping film from a film supply, to have the length of film extend through a region that lies, in the path of product flow through said machine, between the weighing station and a sealing station that is an integral part of said machine, the sealing station being disposed downstream of the weighing station in the direction of said product flow;

enveloping the top portion of the product in the length of stretch wrapping film after the product has been weighed;

tucking at least one edge of the film under the tray bearing the product;

advancing said trayed product and the length of enveloping stretch wrapping film along the path of product flow to said sealing station, to thereby further envelop the trayed product in the stretch wrapping film while the trayed product is being advanced to the sealing station;

severing the length of stretch wrapping film, the severing occurring at a point disposed between said scale and said sealing station, before said product is completely wrapped in said stretch film;

sealing at least certain of the tucked edges under the tray in the sealing station; and applying a label to said stretch wrapping film, after it has been stretched, to specify the weight of the unwrapped trayed product in accordance with said electrical signal, after the film has been tucked under at least certain of the edges of the tray.

2. The method of claim 1 wherein the label is applied to the stretch wrapping film at a location downstream of the sealing station in the direction of product flow.

3. The method of claim 1, further including the step of maintaining said electrical signal stored in digital form in a memory device, while said product is being wrapped.

4. A method for weighing, stretch wrapping and labelling a product in a unitary weighing and wrapping machine for use in supermarkets, retail stores, and the like, comprising:

manually placing an unwrapped product to be weighed and wrapped on a scale in a weighing station that is an integral part of said machine;

weighing the product while it is on said scale before it is wrapped, including generating an electrical signal corresponding to the weight of the unwrapped product;

withdrawihg a length of stretch wrapping film from a film supply, to have the length of film extend through a region that lies, in the path of product flow through said machine, between the weighing station and a sealing station that is an integral part of said machine, the sealing station being disposed downstream of the scale in the direction of said product flow;

enveloping the top portion of the product in the length of stretch wrapping film after the product has been weighed;

tucking at least one edge of the film under the product;

advancing said product and the length of enveloping stretch wrapping film along the path of product flow to said sealing station, to thereby further envelop the product in the stretch wrapping film while the product is being advanced to the sealing station;

severing the length of stretch wrapping film, the severing occurring at a point disposed between said scale and said sealing station, before said product is completely wrapped in said stretch film;

sealing at least certain of the tucked edges under the product in the sealing station; and applying a label to said stretch wrapping film after it has been stretched, to specify the weight of the unwrapped product in accordance with said electrical signal, after the film has been tucked under the product.

5. The method of claim 4, wherein the label is applied to the stretch wrapping film at a location downstream of the sealing station in the direction of product flow.

6. The method of claim 4, further including the step of maintaining said electrical signal stored in digital form in a memory device, while said product is being wrapped.

7. The method of claim 6, wherein the step of enveloping the top portion of the product in the length of stretch wrapping film includes the steps of advancing the product from the weighing station, after it has been weighed, to a product support table, for supporting the product while it is being wrapped, clamping the length of stretch wrapping film above the product support table, and advancing the product support table into the clamped stretch wrapping film.

8. The method of claim 7, wherein the step of tucking at least one edge of the film under the product includes the step of actuating folding members for folding the edges of the film under the product.

9. The method of claim 8, further including the steps automatically advancing said unwrapped product from said weighing station to said product support table in response to the receipt of at least said electrical signal corresponding to the weight of said unwrapped product;

automatically wrapping said product in said length of stretch wrapping film in response to the receipt of at least an electrical signal corresponding to the weight of a first subsequently received unwrapped product;

automatically transferring the wrapped product through said sealing station in response to the receipt of at least an electrical signal corresponding to the weight of a second subsequently received unwrapped product; and automatically applying said label to the wrapped and sealed product in response to the receipt of at least an electrical signal corresponding to the weight of a third subsequently received unwrapped product.

10. A unitary weighing and stretch wrapping machine for use in supermarkets, retail stores, and the like, comprising:

a weighing station forming an integral part of said machine, and having a weighing platform for receiving an unwrapped product;

weight sensing means in said weighing station coupled to said platform to generate an electrical signal corresponding to the weight of said product independent of any stretch wrapping material;

a sealing station forming an integral part of said machine, downstream of said weighing station in the path of product flow through said machine;

film supply means for supplying a length of stretch wrapping film which extends through a region that lies between said weighing station and said sealing station, in the path of said product flow, to wrap said product as it is moved from said weighing station to said sealing station, by enveloping the top portion of the product in said length of stretch film, advancing said product and the length of enveloping stretch wrapping film to said sealing station to thereby further envelop the product in the stretch wrapping film, and tucking two or more edges of said stretch film underneath said product;

film severing means forming an integral part of said machine and disposed between said weighing station and said sealing station, for severing said length of stretch film from said film supply means before said product is completely wrapped in said stretch film;

said sealing station adapted to seal the edges of said stretch film under said product; and a labelling station for producing a label to specify the weight of the unwrapped product, in accordance with said electrical signal, for application to the wrapped product after the edges of said stretch film are sealed under said product.

11. The machine of claim 10, further including digital storage means for maintaining said electrical signal stored in digital form, while said product is being wrapped.

12. A method for weighing, wrapping and labeling a product on a tray, comprising manually placing a trayed product to be weighed and wrapped on a surface in a weighing station, weighing the trayed product while it is on said surface before it is wrapped, including generating an electrical signal corresponding to the weight of the product and storing said signal in a memory device, withdrawing a length of stretch wrapping film from a film supply to have the length of film extend through a region that lies between the weighing station and a sealing station, moving the trayed product into the length of stretch wrapping film, tucking at least the leading edge of the film under the tray bearing the product, advancing said trayed product and the length of stretch wrapping film to a sealing station, tucking at least one of the edges of said stretch film under an edge of said tray while the trayed product is being advanced to the sealing station, sealing the tucked edges under the tray in the sealing station, and applying a label to said stretch film after it has been stretched to specify the weight of the product in accordance with the weight signal stored in the memory device, after the film has been tucked under at least certain of the edges of the tray.

13. The method of claim 12 wherein the step of moving the trayed product into the length of stretch wrapping film serves to stretch the film about the product, and the step of tucking at least one of the edges under the tray while the trayed product is being advanced to the sealing station occurs after the trayed product has been moved into the film.

14. The method of claim 12 further including the step of stretching the length of stretch wrapping film before the trayed product is moved into said length of film.

15. The method of claim 12 wherein the step of tucking at least one of the edges under the tray while the trayed product is being advanced to the sealing station includes restraining the trailing edge of the film at least during the initial advancement of the trayed product to the sealing station, to cause the trailing edge of the film to tuck under the tray.

16. A method for weighing, wrapping and labeling a product on a tray, comprising manually placing a trayed product to be weighed and wrapped on a surface in a weighing station, weighing the trayed product while it is on said surface before it is wrapped, including generating an electrical signal corresponding to the weight of the product and storing said signal in a memory device, withdrawing a length of stretch wrapping film from a film supply to have the length of film extend through a region that lies between the weighing station and a sealing station, pre-stretching said length of film in the direction perpendicular to the direction of withdrawal, moving the trayed product into the prestretched length of film, tucking at least the leading edge of the film under the tray bearing the product, advancing said trayed product and the length of stretch wrapping film to a sealing station, tucking at least one of the edges of said stretch film under an edge of said tray while the trayed product is being advanced to the sealing station, sealing the tucked edges under the tray in the sealing station, and applying a label to said stretch film after it has been stretched to specify the weight of the product in accordance with the weight signal stored in the memory device, after the film has been tucked under at least certain of the edges of the tray.

17. The method of claim 16 wherein the step of advancing the trayed product comprises advancing it into the pre-stretched stretch wrapping film to stretch the film about the product, and the step of tucking at least one of the edges under the tray while the trayed product is being advanced to the sealing station occurs after the trayed product has been advanced into the film.

18. A method for weighing, stretch wrapping and labelling a product in a unitary weighing and wrapping machine for use in supermarkets, retail stores, and the like, comprising:

manually placing an unwrapped product to be weighed and wrapped on a scale in a weighing station that is an integral part of said machine;

weighing the product while it is on said scale before it is wrapped, including generating an electrical signal corresponding to the weight of the unwrapped product;

grasping the leading edge of a supply of stretch wrapping film from a film-holding member which is an integral part of said machine;

pulling said film from the film supply to thereby withdraw, in a longitudinal direction, a length of stretch wrapping film therefrom;

enveloping the top portion of the product in the length of stretch wrapping film after the product has been weighed;

tucking said leading edge of the film under the product;

advancing paid product and the length of enveloping stretch wrapping film along the path of product flow toward a sealing station, to thereby further envelop the product in the stretch wrapping film while the product is being advanced to the sealing station;

severing the length of stretch wrapping film from said film supply, to produce a second edge opposite said leading edge, the severing occurring before said product is completely wrapped in said stretch film;

further advancing said product so that said second edge overlies said leading edge;

sealing at least certain of the tucked edges under the product in the sealing station; and applying a label to said stretch wrapping film after it has been stretched, to specify the weight of the unwrapped product in accordance with said electrical signal, after the film has been tucked under the product.

19. The method of claim 18 wherein the length of film is severed after the top portion of said product is enveloped in said film.

20. The method of claim 14 further including stretching said film in a lateral direction, transverse to said longitudinal direction.

21. The method of claim 20, wherein said film is stretched in said lateral direction before enveloping the top portion of said product in said stretch film.

22. A unitary weighing and stretching wrapping machine for use in supermarkets, retail stores, and the like, comprising:

a weighing station forming an integral part of said machine, and having a weighing platform for receiving an unwrapped product;

weight sensing means in said weighing station coupled to said platform to generate an electrical signal corresponding to the weight of said product independent of any stretch wrapping material;

a sealing station downstream of said weighing station in the path of product flow through said machine;

film supply means including a film-holding member for holding the leading edge of a supply of stretch-wrapping film, for supplying a length of said stretch wrapping film said to wrap said product as it is moved from said weighing station toward said sealing station, by enveloping the top portion of the product in said length of stretch film, advancing said product and the length of enveloping stretch wrapping film to said sealing station to thereby further envelop the product in the stretch wrapping film, and tucking said leading edge of said stretch film underneath said product, said film-holding member forming an integral part of said machine;

film severing means forming an integral part of said machine for severing said length of stretch film from said film supply means before said product is completely wrapped in said stretch film;

said sealing station adapted to seal the edges of said stretch film under said product; and a labelling station for producing a label to specify the weight of the unwrapped product, in accordance with said electrical signal, for application to the wrapped product after the edges of said stretch film are sealed under said product.

* * * * *

UNITED STATES PATENT AND TRADEMARK OFFICE

CERTIFICATE OF CORRECTION

PATENT NO. : 4,548,024

DATED : October 22, 1985

INVENTOR(S) : Fine

It is certified that error appears in the above—identified patent and that said Letters Patent is hereby corrected as shown below:

Column 17, line 27, delete "noted (", and insert therefor --noted,--;

Column 20, line 19, delete "withdrawihg", and insert therefor --withdrawing--;

Column 20, line 66, after "steps", insert --of--;

Column 24, line 4, delete "claim 14", and insert therefor --claim 19--; and

On the title page, under "References Cited", "U.S. Patent Documents", insert --3,662,513 5/1972 Fabbri ... ..... 53/33--.

Signed and Sealed this

*Fifth* Day of *August 1986*

[SEAL]

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : B1 4,548,024

DATED : March 29, 1988

INVENTOR(S) : Harvey A. Fine

It is certified that error appears in the above-identified patent and that said Letters Patent is hereby corrected as shown below:

Column 1, line 31, delete "and" and insert therefor --and--

Column 1, line 51; column 2, lines 24 and 25; column 2, line 62;

Column 4, line 30; and column 5, line 3, delete "envelope" and insert therefor --envelop--;

Column 3, line 19, delete "[;], and insert therefor --[,];--;

Column 4, delete lines 40 and 41.

Signed and Sealed this

Second Day of May, 1989

*Attest:*

*Attesting Officer*

DONALD J. QUIGG

*Commissioner of Patents and Trademarks*

REEXAMINATION CERTIFICATE (832nd)

United States Patent [19]

Fine

[11] B1 4,548,024

[45] Certificate Issued Mar. 29, 1988

[54] INTEGRATED STRETCH-WRAP PACKAGING SYSTEM

[75] Inventor: Harvey A. Fine, Sayreville, N.J.

[73] Assignee: Weldotron Corporation, Piscataway, N.J.

Reexamination Request:
No. 90/001,168, Feb. 9, 1987
No. 90/001,206, Mar. 25, 1987

Reexamination Certificate for:

| | |
|---|---|
| Patent No.: | **4,548,024** |
| Issued: | **Oct. 22, 1985** |
| Appl. No.: | **580,129** |
| Filed: | **Apr. 16, 1984** |

Certificate of Correction issued Aug. 5, 1986.

Related U.S. Application Data

[62] Division of Ser. No. 245,283, Mar. 19, 1981, Pat. No. 4,458,470.

[51] Int. Cl.[4] ..... B65B 11/16

[52] U.S. Cl. ..... 53/502; 53/441; 53/389; 53/556

[58] Field of Search ..... 53/441, 427, 502, 556, 53/389, 64, 66; 177/145, 211, 210, 3-6, 12, 25, 165, 245; 156/360, 350

[56] References Cited

U.S. PATENT DOCUMENTS

| | | | |
|---|---|---|---|
| 2,259,866 | 10/1941 | Stokes . | |
| 2,887,837 | 5/1959 | Toby . | |
| 3,162,258 | 12/1964 | Schmidt . | |
| 3,194,710 | 7/1965 | Stremke et al. . | |
| 3,244,278 | 4/1966 | Weprin et al. . | |
| 3,276,526 | 10/1966 | Loshbough . | |
| 3,289,386 | 12/1966 | Farmer . | |
| 3,293,824 | 12/1966 | Dorr . | |
| 3,342,661 | 9/1967 | Arvidson et al. . | |
| 3,372,079 | 3/1968 | Fellner et al. . | |
| 3,384,524 | 5/1968 | Hansen, Jr. . | |
| 3,453,167 | 7/1969 | Arvidson et al. . | |
| 3,461,984 | 8/1969 | Phillips et al. . | |
| 3,486,294 | 12/1969 | Vilen . | |
| 3,537,235 | 11/1970 | Pepmeier et al. . | |
| 3,540,971 | 11/1970 | Johanski, Jr. . | |
| 3,545,588 | 12/1970 | Corley | 198/19 |
| 3,579,949 | 4/1971 | Michels | 53/390 X |
| 3,650,773 | 3/1972 | Bush et al. . | |
| 3,662,511 | 5/1972 | Eliasberg . | |
| 3,662,513 | 5/1972 | Fabbri | 53/33 |
| 3,692,129 | 9/1972 | Pratt et al. | 177/211 |
| 3,732,966 | 5/1973 | Treiber . | |
| 3,815,313 | 6/1974 | Heisler | 53/14 |
| 3,846,958 | 11/1974 | Divan . | |
| 3,967,433 | 7/1976 | Bonfiglioli . | |
| 4,029,161 | 6/1977 | Foster et al. . | |
| 4,101,366 | 7/1978 | Teraoka et al. . | |
| 4,205,501 | 6/1980 | Michels . | |
| 4,276,112 | 6/1981 | French et al. . | |
| 4,415,048 | 11/1983 | Teraoka | 177/5 |

FOREIGN PATENT DOCUMENTS

| | | |
|---|---|---|
| 0061144 | of 1982 | European Pat. Off. . |
| 1033881 | of 1975 | Italy . |
| 4204976 | 10/1977 | Japan . |
| 54-123391 | 9/1979 | Japan . |
| 3821780 | 3/1980 | Japan . |
| 55-38217 | 3/1980 | Japan . |

OTHER PUBLICATIONS

"Printed PVC stretches Prepackaging prospects", *Packaging Digest*, Mar. 1975.

Franklin Electric Catalog, Section 200, pp. 200.001 and 200.005, May 5, 1974, entitled "Fully Automatic Shrink Film Wrapping".

Franklin Electric Catalog, Section 200, p. 200.011, May 5, 1974, entitled "Fully Automatic 180° Wrapping".

Franklin Electric Catalog, Section 200, p. 200.031, May 5, 1974, entitled "Semi-Automatic Heated Belt System".

Toledo Scale Flyer, designated Form SW-1452, undated, entitled "303MP For Stretch Or Shrink Film Packaging".

Toledo Scale Flyer, designated Form 1454, undated, entitled "303MP/Auto-Labeler, Single Station Wrap And Weigh Systems".

Toledo Scale Flyer, designated Form 1464, undated, entitled "Super-wrapper, 513/Auto-Labeler, Single Station Wrap And Weigh System.

Toledo Scale Flayer, design, Form 1466, undated, entitled "The Step Saver System, Ideal For Packaging Produce Or Meats".

Toledo Scale Flyer, design, Form 1470, undated, entitled "Super-wrapper, Soft Film System No. 1".

Hobart brochure, undated, entitled "Automatic Shrink Film Wrap-Weigh-Label Systems".

Franklin Electric Catalog, Section 200, p. 200.069, Apr. 15, 1977, entitled "Mechanical Console Hand Wrapper M-100 Series".

Franklin Electric Catalog, Section 200, p. 200.071, Apr. 15, 1977, entitled "Mechanical Console Hand Wrapper M200".

Franklin Electric Catalog, Section 100, pp. 100.021 and 100.023, May 5, 1974, entitled "Digimatic Scale Printer".

*Primary Examiner*—James F. Coan

[57] ABSTRACT

The disclosure concerns an integral weigh wrapper for wrapping products in stretch film, by weighing each product as it is placed on an infeed support surface, and feeding successive weight signals to a data processor. Successive signals are compared, and when a stabilized weight signal is received, as determined by the successive comparisons, the data processor produces a start signal which activates a drive motor to rotate one revolution. This initiates one cycle of operation of the weigh wrapper, in which the product is advanced from the infeed station to the wrapping station, a wrapping cycle is initiated for any product then in the wrapping station, and a previously wrapped product is advanced to a printing and labeling station—where it is automatically indexed, a printed label pneumatically applied to a selected location on the wrapper, and the wrapped and labeled product outputted.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 4, 10, 12, 16, 18 and 22 are determined to be patentable as amended.

Claims 2, 3, 5-9, 11, 13-15, 17, and 19-21, dependent on an amended claim, are determined to be patentable.

1. A method for weighing, stretch wrapping and labelling a trayed product in a unitary weighing and wrapping machine for use in supermarkets, retail stores, and the like, comprising:

manually placing an unwrapped trayed product to be weighed and wrapped on a scale in a weighing station that is an integral part of said machine;

*immediately* weighing the trayed product while it is on said scale before it is wrapped, [including] and generating an electrical signal corresponding to the weight of the unwrapped trayed product;

withdrawing a length of stretch wrapping film from a film supply, to have the length of film extend through a region that lies, in the path of product flow through said machine, between the weighing station and a sealing station that is an integral part of said machine, the sealing station being disposed downstream of the weighing station in the direction of said product flow;

enveloping the top portion of the product in the length of stretch wrapping film after the product has been weighed;

tucking at least one edge of the film under the tray bearing the product;

advancing said trayed product and the length of enveloping stretch wrapping film along the path of product flow to said sealing station, to thereby further envelope the trayed product in the stretch wrapping film while the trayed product is being advanced to the sealing station;

severing the length of stretch wrapping film, the severing occurring at a point disposed between said scale and said sealing station, before said product is completely wrapped in said stretch film;

sealing at least certain of the tucked edges under the tray in the sealing station; and applying a label to said stretch wrapping film, after it has been stretched, to specify the weight of the unwrapped trayed product in accordance with said electrical signal, after the film has been tucked under at least certain of the edges of the tray.

4. A method for weighing, stretch wrapping and labelling a product in a unitary weighing and wrapping machine for use in supermarkets, retail stores, and the like, comprising:

manually placing an unwrapped product to be weighed and wrapped on a scale in a weighing station that is an integral part of said machine;

*immediately* weighing the product while it is on said scale before it is wrapped, [including] *and* generating an electrical signal corresponding to the weight of the unwrapped product;

withdrawing a length of stretch wrapping film from a film supply, to have the length of film extend through a region that lies, in the path of product flow through said machine, between the weighing station and a sealing station that is an integral part of said machine, the sealing station being disposed downstream of the scale in the direction of said product flow;

enveloping the top portion of the product in the length of stretch wrapping film after the product has been weighed;

tucking at least one edge of the film under the product;

advancing said product and the length of enveloping stretch wrapping film along the path of product flow to said sealing station, to thereby further envelope the product in the stretch wrapping film while the product is being advanced to the sealing station;

severing the length of stretch wrapping film, the severing occurring at a point disposed between said scale and said sealing station, before said product is completely wrapped in said stretch film;

sealing at least certain of the tucked edges under the product in the sealing station; and applying a label to said stretch wrapping film after it has been stretched, to specify the weight of the unwrapped product in accordance with said electrical signal, after the film has been tucked under the product.

10. A unitary weighing and stretch wrapping machine for use in supermarkets, retail stores, and the like, comprising:

a weighing station forming an integral part of said machine, and having a weighing platform for *manually* receiving an unwrapped product *to thereby immediately initiate the weighing of said product;* weight sensing means in said weighing station coupled to said platform to generate an electrical signal corresponding to the weight of said product independent of any stretch wrapping material;

a sealing station forming an integral part of said machine, downstream of said weighing station in the path of product flow through said machine;

film supply means for supplying a length of stretch wrapping film which extends through a region that lies between said weighing station and said sealing station, in the path of said product flow, to wrap said product as it is moved from said weighing station to said sealing station, by enveloping the top portion of the product in said length of stretch film, advancing said product and the length of enveloping stretch wrapping film to said sealing station to thereby further envelope the product in the stretch wrapping film, and tucking two or more edges of said stretch film underneath said product;

film severing means forming an integral part of said machine and disposed between said weighing station and said sealing station, for severing said length of stretch film from said film supply means before said product is completely wrapped in said stretch film;

said sealing station adapted to seal the edges of said stretch film under said product; and a labelling station for producing a label to specify the weight of the unwrapped product, in accordance with said electrical signal, for application to the wrapped product after the edges of said stretch film are sealed under said product.

12. A method for weighing, wrapping and labeling a product on a tray, comprising:

manually placing a trayed product to be weighed and wrapped on a surface in a weighing station[,];

*immediately* weighing the trayed product while it is on said surface before it is wrapped, [including] *and* generating an electrical signal corresponding to the weight of the product and storing said signal in a memory device[;], withdrawing a length of stretch wrapping film from a film supply to have the length of film extend through a region that lies between the weighing station and a sealing station[,];

moving the trayed product into the length of stretch wrapping film[,];

tucking at least the leading edge of the film under the tray bearing the product[,];

advancing said trayed product and the length of stretch wrapping film to a sealing station[,];

tucking at least one of the edges of said stretch film under an edge of said tray while the trayed product is being advanced to the sealing station[,];

sealing the tucked edges under the tray in the sealing station[,]; and applying a label to said stretch film after it has been stretched to specify the weight of the product in accordance with the weight signal stored in the memory device, after the film has been tucked under at least certain of the edges of the tray.

16. A method for weighing, wrapping and labeling a product on a tray, comprising:

manually placing a trayed product to be weighed and wrapped on a surface in a weighing station[,];

*immediately* weighing the trayed product while it is on said surface before it is wrapped, [including] *and* generating an electrical signal corresponding to the weight of the product and storing said signal in a memory device[,];

withdrawing a length of stretch wrapping film from a film supply to have the length of film extend through a region that lies between the weighing station and a sealing station[,];

pre-stretching said length of film in the direction perpendicular to the direction of withdrawal[,];

moving the trayed product into the [prestretched] *pre-stretched* length of film[,];

tucking at least the leading edge of the film under the tray bearing the product[,];

advancing said trayed product and the length of stretch wrapping film to a sealing station[,];

tucking at least one of the edges of said stretch film under an edge of said tray while the trayed product is being advanced to the sealing station[,];

sealing the tucked edges under the tray in the sealing station[,]; and applying a label to said stretch film after it has been stretched to specify the weight of the product in accordance with the weight signal stored in the memory device, after the film has been tucked under at least certain of the edges of the tray.

18. A method for weighing, stretch wrapping and labelling a product in a unitary weighing and wrapping machine for use in supermarkets, retail stores, and the like, comprising:

manually placing an unwrapped product to be weighed and wrapped on a scale in a weighing station that is an integral part of said machine;

*immediately* weighing the product while it is on said scale before it is wrapped, [including] *and* generating an electrical signal corresponding to the weight of the unwrapped product;

grasping the leading edge of a supply of stretch wrapping film from a film-holding member which is an integral part of said machine;

pulling said film from the film supply to thereby withdraw, in a longitudinal direction, a length of stretch wrapping film therefrom;

enveloping the top portion of the product in the length of stretch wrapping film after the product has been weighed;

tucking said leading edge of the film under the product; advancing *said* [paid] product and the length of enveloping stretch wrapping film along the path of product flow toward a sealing station, to thereby further envelope the product in the stretch wrapping film while the product is being advanced to the sealing station;

severing the length of stretch wrapping film from said film supply, to produce a second edge opposite said leading edge, the severing occurring before said product is completely wrapped in said stretch film;

further advancing said product so that said second edge overlies said leading edge;

weighed and further advancing said product so that said second edge overlies said leading edge;

sealing at least certain of the tucked edges under the product in the sealing station; and applying a label to said stretch wrapping film after it has been stretched, to specify the weight of the unwrapped product in accordance with said electrical signal, after the film has been tucked under the product.

22. A unitary weighing and [stretching] *stretch* wrapping machine for use in supermarkets, retail stores, and the like, comprising:

a weighing station forming an integral part of said machine, and having a weighing platform for *manually* receiving an unwrapped product *to thereby immediately initiate the weighing of said product;* weight sensing means in said weighing station coupled to said platform to generate an electrical signal corresponding to the weight of said product independent of any stretch wrapping material;

a sealing station downstream of said weighing station in the path of product flow through said machine;

film supply means including a film-holding member for holding the leading edge of a supply of stretch-wrapping film, for supplying a length of said stretch wrapping film said to wrap said product as it is moved from said weighing station toward said sealing station, by enveloping the top portion of the product in said length of stretch film, advancing said product and the length of enveloping stretch wrapping film to said sealing station to thereby further envelope the product in the stretch wrapping film, and tucking said leading edge of said stretch film underneath said product, said film-holding member forming an integral part of said machine;

film severing means forming an integral part of said machine for severing said length of stretch film from said film supply means before said product is completely wrapped in said stretch film;

said sealing station adapted to seal the edges of said stretch film under said product; and a labelling station for producing a label to specify the weight of the unwrapped product, in accordance with said electrical signal, for application to the wrapped product after the edges of said stretch film are sealed under said product.

* * * * *